US006651265B2

(12) United States Patent
Kwen

(10) Patent No.: US 6,651,265 B2
(45) Date of Patent: Nov. 25, 2003

(54) WATER SAVING SIPHON COVER OF A CHAMBER POT

(75) Inventor: Jeung-Ui Kwen, Seoul (KR)

(73) Assignee: Weglo Co., Ltd., Seoul (KR)

( * ) Notice: Subject to any disclaimer, the term of this patent is extended or adjusted under 35 U.S.C. 154(b) by 0 days.

(21) Appl. No.: 10/252,779

(22) Filed: Sep. 23, 2002

(65) Prior Publication Data

US 2003/0106144 A1 Jun. 12, 2003

(30) Foreign Application Priority Data

Dec. 11, 2001 (KR) ..... 20-2001-38243

(51) Int. Cl.[7] ..... E03D 1/35
(52) U.S. Cl. ..... 4/404; 4/325
(58) Field of Search ..... 4/378, 392, 393, 4/395, 403, 404, 324, 325

(56) References Cited

U.S. PATENT DOCUMENTS 1,775,934 A * 9/1930 Delany ..... 4/397
4,497,076 A * 2/1985 Sullivan ..... 4/392
5,390,375 A * 2/1995 Fernstrum, Jr. ..... 4/404
6,381,765 B1 * 5/2002 Liu ..... 4/404

* cited by examiner

*Primary Examiner*—Charles E. Phillips
(74) *Attorney, Agent, or Firm*—Levine & Mandelbaum

(57) ABSTRACT

The water saving siphon cover 100 comprises a flexible air chamber 10 and a rigid air housing 20 connected to the lower side of the air chamber 10 to form an air room 30 inside. The air chamber 10 comprises a supporting portion 11, a variable portion 12 having a horizontal portion 12*a* and a sloping portion 12*b*, a ceiling portion 13 closing the upper side of the variable portion 12, an outer flange 15, and a pair of hinge portions 17, each being extended from one side of the outer flange 15. The cup shaped air housing 20 comprises a suction hole 22 and an air vent 23. The water saving siphon cover 100 is installed such that the end of the hinge portion 17 blocks an outlet port 36 in a water tank 37, being hinged to the overflow tube 31. Thus, the water saving siphon cover 100 can save water according to the required amount of wash water based on a change in the opening time of the outlet port 36 caused by a difference between the buoyant force for flushing urine and the buoyant force for flushing feces.

4 Claims, 8 Drawing Sheets

【FIG 1】
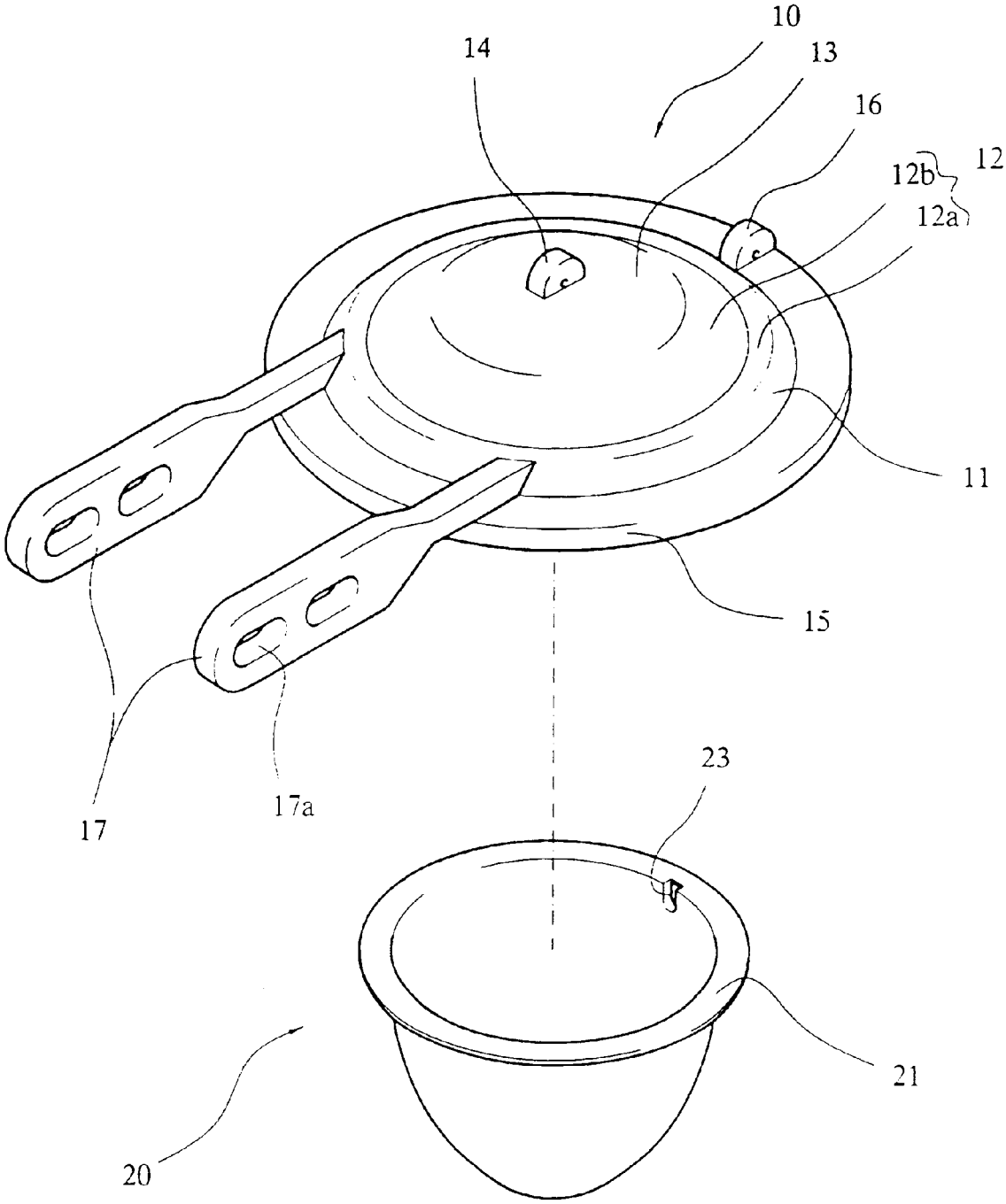

【FIG 2】
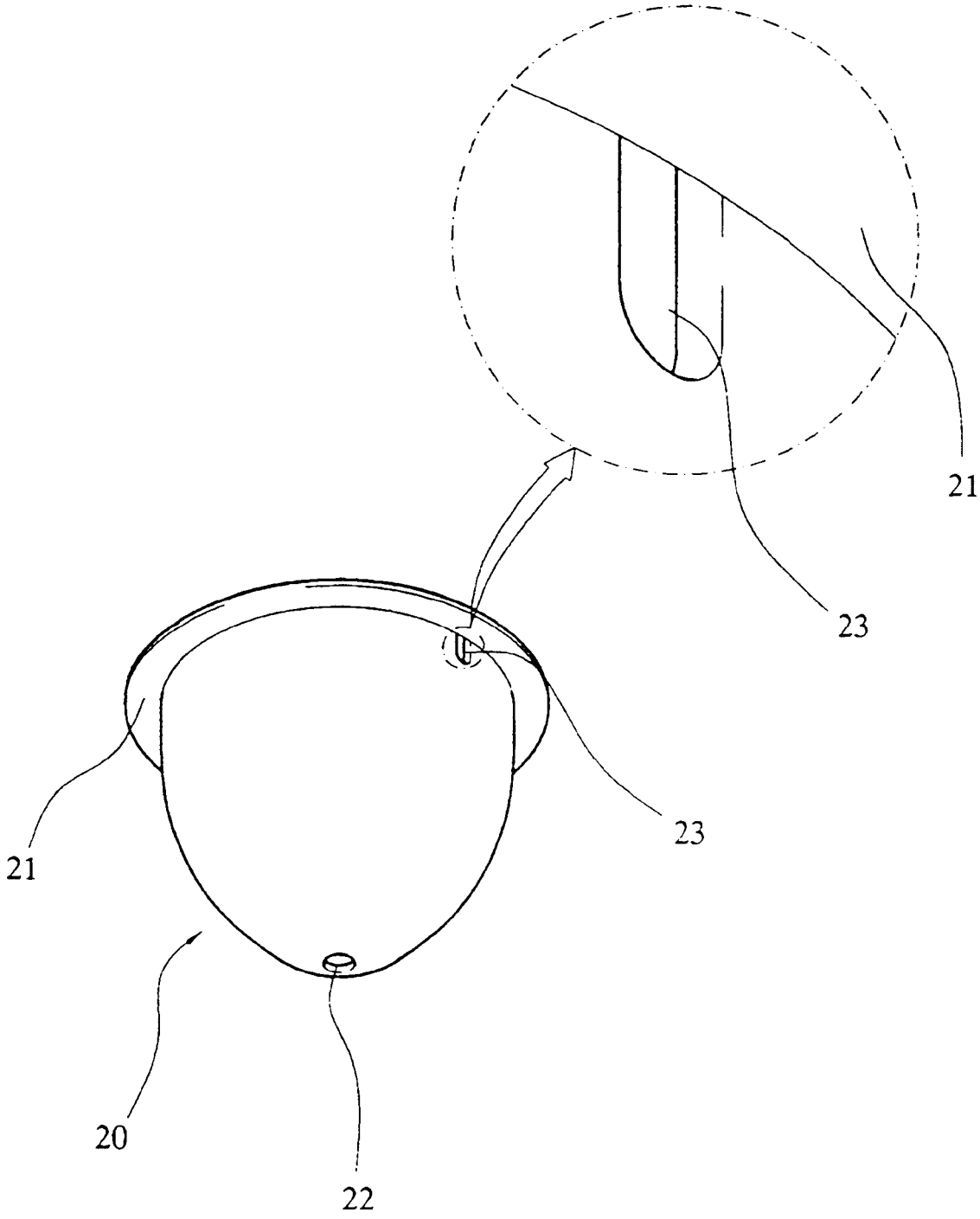

【FIG 3】
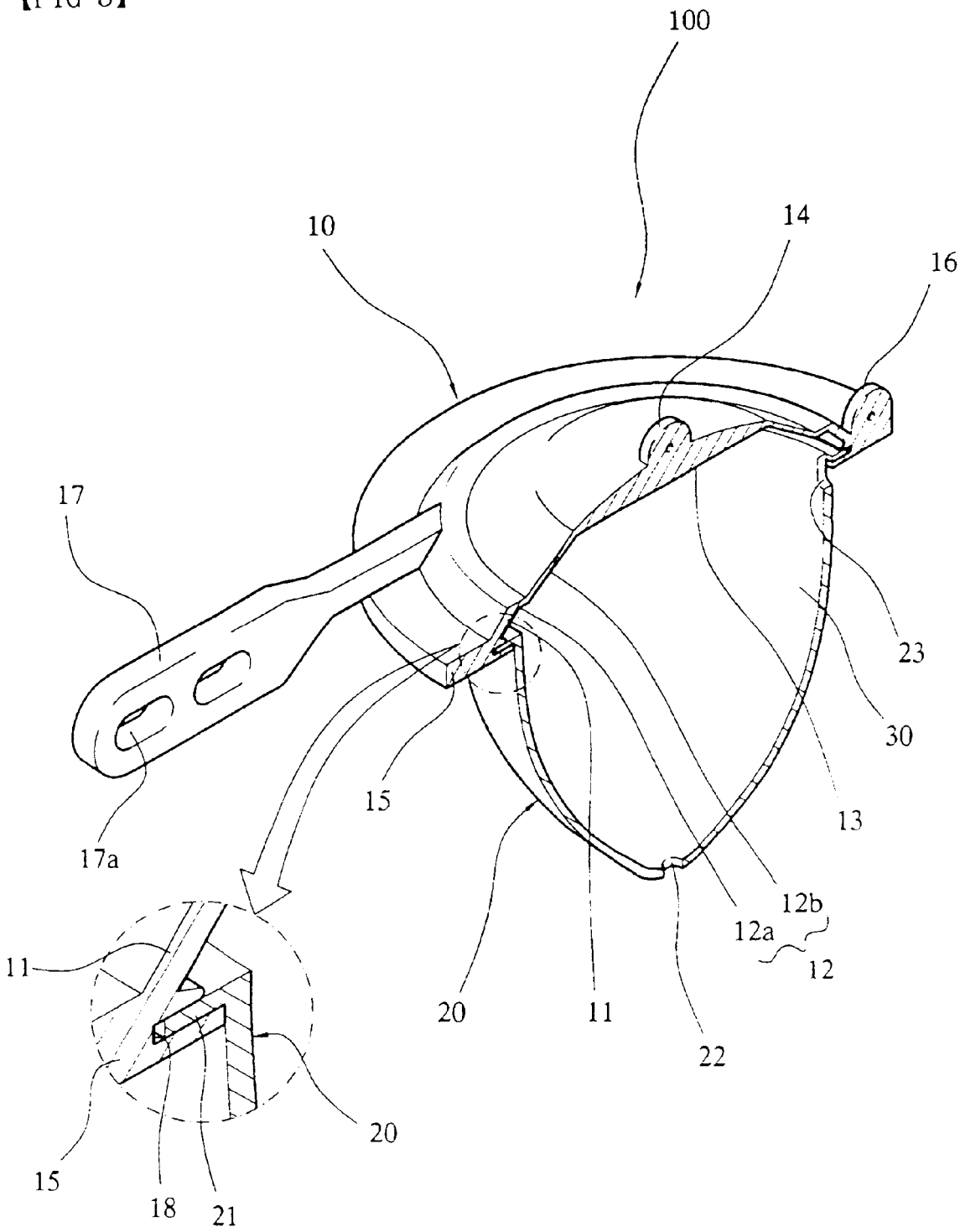

【FIG 4】
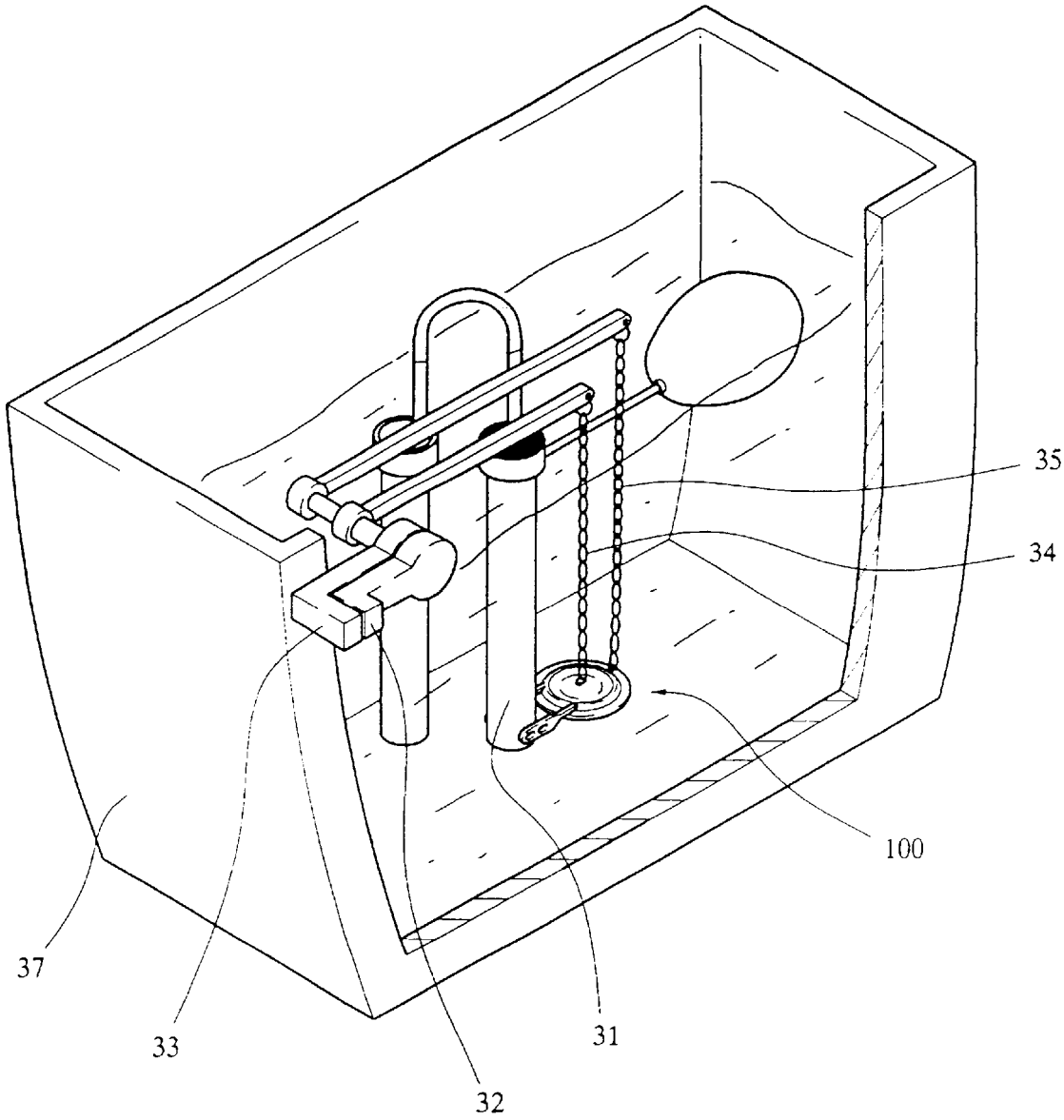

【FIG 5】
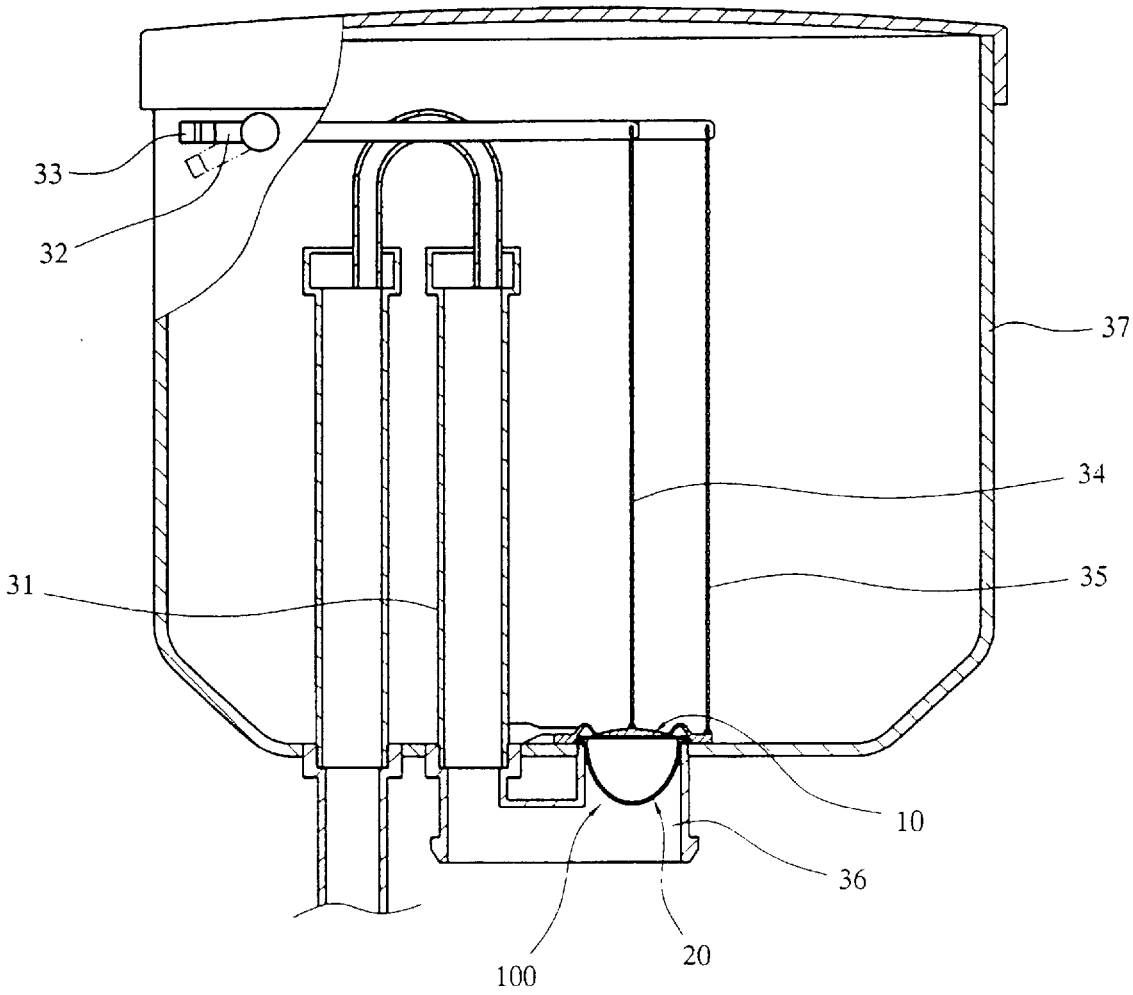

【FIG 6】
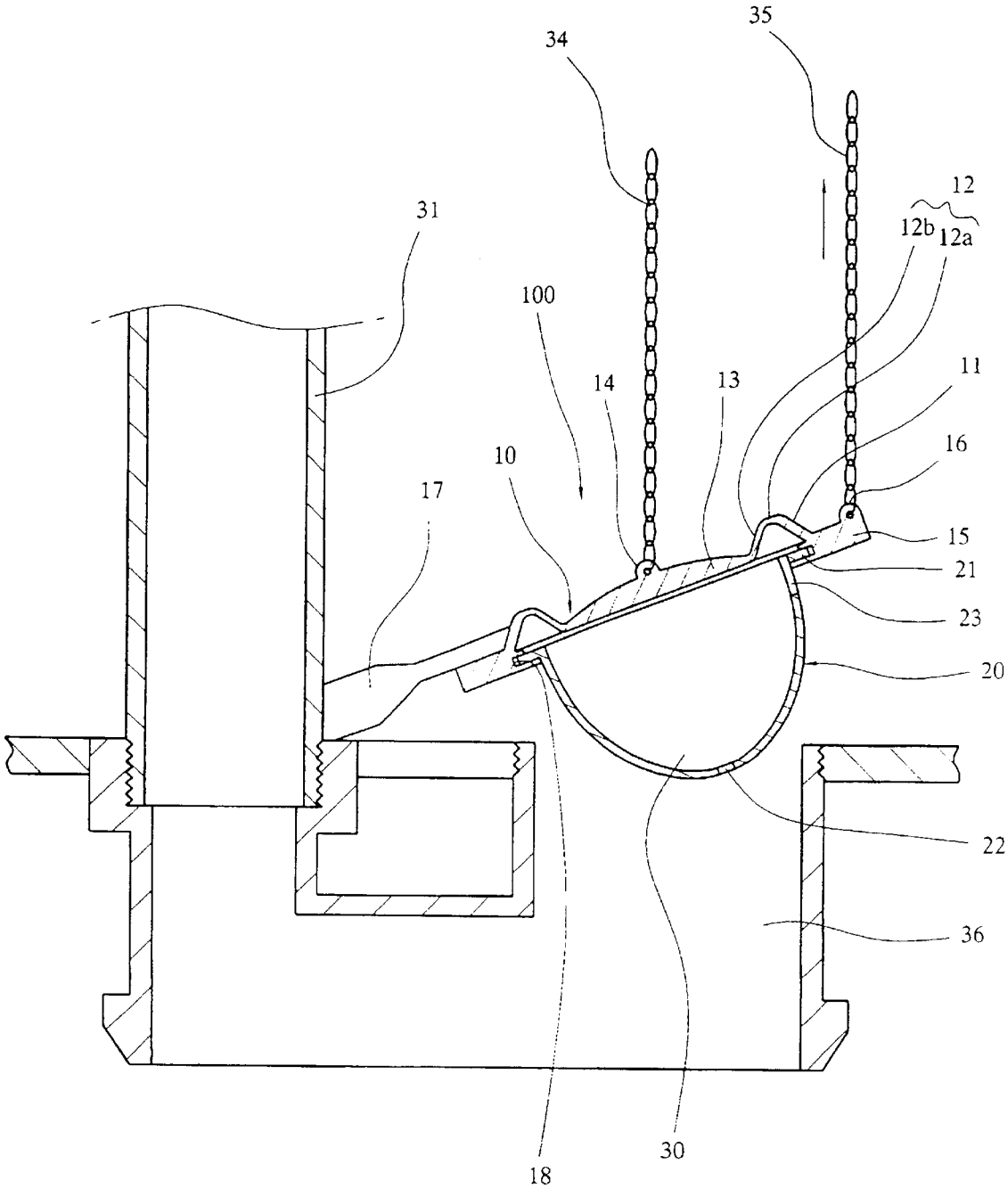

【FIG 7】
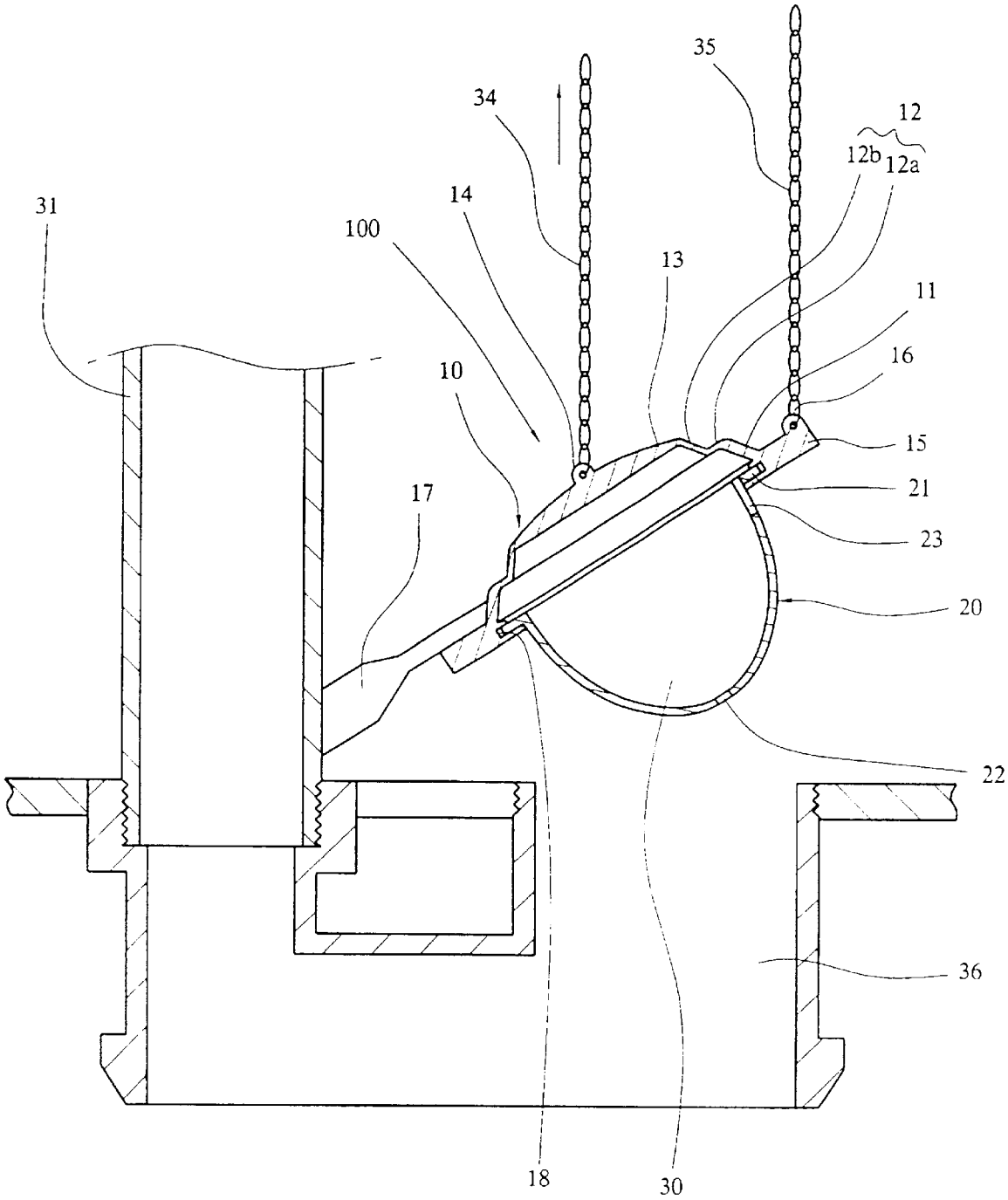

【FIG 8】
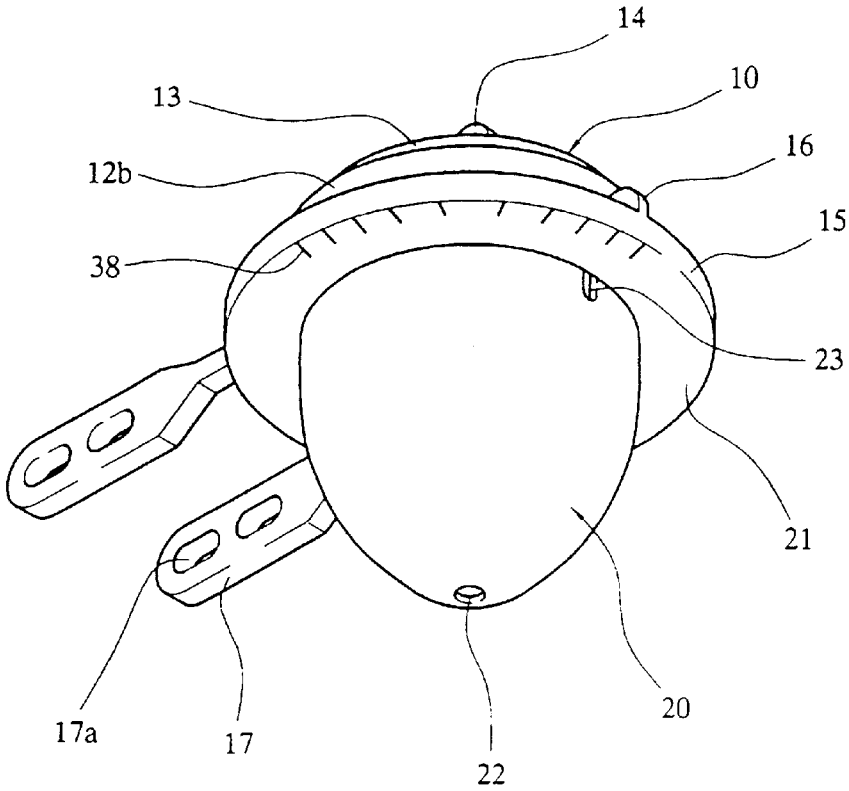
【FIG 9】
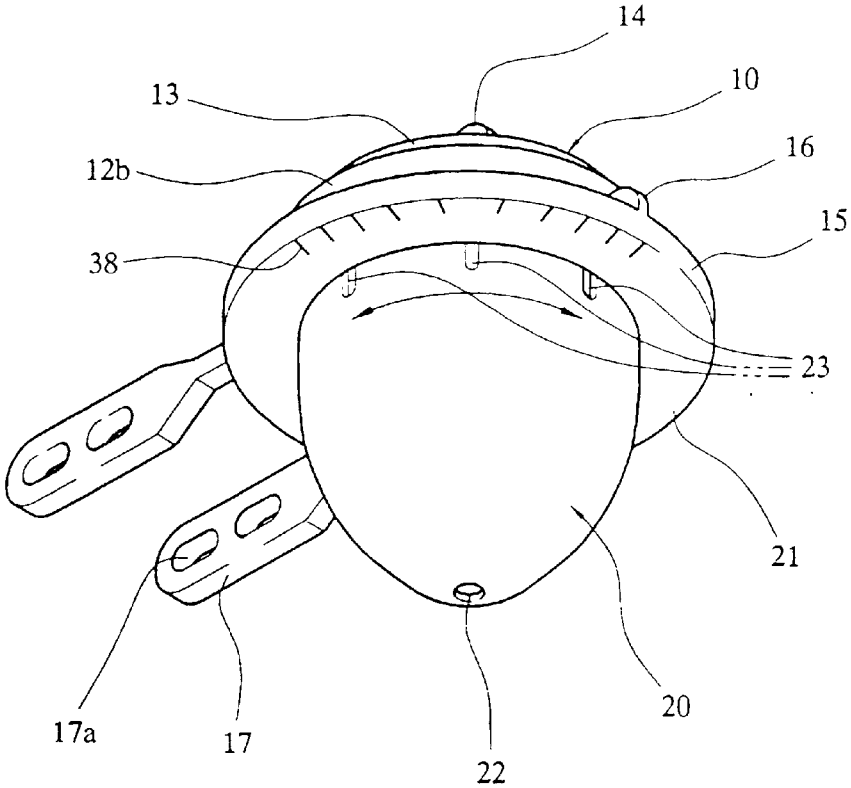

WATER SAVING SIPHON COVER OF A CHAMBER POT

BACKGROUND OF THE INVENTION

1. Field of the Invention

The present invention relates to a water saving siphon cover of a chamber pot which is installed at a discharge pipe in a water tank of the chamber pot in order to save water according to the type of waste to be disposed.

2. Description of the Related Art

Generally, on the upper, rear portion of the chamber pot of low tank type commonly used in toilets is provided a low tank (hereinafter, "water tank") for storing wash water. Recently, at the interior of the water tank, a water saving apparatus is installed, thereby allowing water to be saved according to the required amount of wash water, which is different based on the type of waste being disposed.

The water saving apparatus of the chamber pot used for this purpose includes a wide variety of variations.

One of them is a water saving apparatus (so-called a siphon cover) which has two outlets of different heights for discharging wash water in the water tank into the pot, each of the outlets being moved in conjunction with a maxi-flush lever or a mini-flush lever, respectively. However, such a construction is very complicated for thereby increasing the design and production costs for the entire chamber pot and the production and installation costs for the water saving apparatus.

Another is an integral-type water saving system which is constructed such that water is to be saved by installing one water saving apparatus at one outlet port and controlling the time for opening the outlet port according to a buoyant force which is different based on the type of waste being disposed. However, in such a structure, a S-shaped variable portion may be wrongly operated many times, which is pressed by the hydraulic pressure of wash water to thus be located at the lower side at usual times, is raised upwardly to thus be restored to the original position upon the operation of the maxi-flush lever, acquires an inner space thus to increase the buoyant force of the water saving apparatus, and then is pressed downwardly again. Particularly, it is often the case that the variable corrugation portion cannot perform its function because of the vacuum generated when the corrugated trap is shrunk and then is closely contacted with an inner surface of the chamber. To prevent this, on an inner surface of the chamber may be formed a contact preventing protrusion. However, it is difficult to mold this structure, which can cause the increase of production cost.

SUMMARY OF THE INVENTION

It is, therefore, an object of the present invention to provide a water saving siphon cover of a very simple structure which prevents the mutual adhesion at the inner surface of an air chamber from the structural viewpoint and eliminates malfunctions by simplifying a variable portion.

To achieve the above object, there is provided a water saving siphon cover in accordance with the present invention, which comprises: a flexible air chamber provided with a supporting portion which is thick and forms a wall body in the sloping shape that provides a smaller diameter as it goes upwardly, a variable portion having a horizontal portion and a sloping portion and being extended at a small thickness in the shape of being contracted in a stepwise manner upwardly from the peripheral surface of the upper side of the supporting portion, a ceiling portion with a maxi-flush loop at the center of the upper surface which blocks the upper side of the variable portion with a large thickness such that it can change the internal volume as the height is changed up and down according to a change of the variable portion caused by an external force, an outer flange which is formed widely outwardly along the peripheral surface of the lower end portion of the supporting portion and has a coupling recess formed convexly along the inner periphery and a mini-flush loop formed at one side of the upper surface, and a pair of hinge portions, each being extended from one side of the outer flange and each end being hinged to the protrusion of the overflow tube; and a rigid air housing formed in a cup shape that is protruded downwardly such that the inside can form an air room along with the inside of the air chamber, said air housing having a coupling flange extended widely outwardly along the peripheral surface of the upper end portion completely open so that it can be coupled to the coupling recess of the air chamber, a suction hole penetrated through the center of the bottom and an air vent penetrated through one side of the upper portion thereof.

BRIEF DESCRIPTION OF THE DRAWINGS

The above objects, features and advantages of the present invention will become more apparent from the following detailed description when taken in conjunction with the accompanying drawings, in which:

FIG. 1 is an exploded perspective view of a water saving siphon cover in accordance with the present invention;

FIG. 2 is a perspective bottom view of an air housing;

FIG. 3 is a partial cut-away perspective view of the water saving siphon cover in accordance with the present invention;

FIG. 4 is a perspective view of the water saving siphon cover in accordance with the present invention when it is installed;

FIG. 5 is a cross-sectional view of the water saving siphon cover in accordance with the present invention when it is installed;

FIG. 6 is a cross-sectional view of the water saving siphon cover in accordance with the present invention when it is used for flushing urine;

FIG. 7 is a cross-sectional view of the water saving siphon cover in accordance with the present invention when it is used for flushing feces;

FIG. 8 is a perspective bottom view showing a flow adjust scale; and

FIG. 9 is a perspective bottom view showing a flow adjust method.

DETAILED DESCRIPTION OF THE PREFERRED EMBODIMENT

A preferred embodiment of the present invention will now be described with reference to the accompanying drawings.

FIG. 1 is an exploded perspective view showing a water saving siphon cover of the present invention; FIG. 2 is a perspective bottom view of an air housing; and FIG. 3 is a partial cut-away perspective view showing the water saving siphon cover of the present invention.

As illustrated in the drawings, the water saving siphon cover 100 comprises a flexible air chamber 10 and a rigid air housing 20 connected to the lower side of the air chamber 10 to form an air room 30 inside. A detailed construction thereof will be described below.

Firstly, as shown in FIGS. 1 and 3, the air chamber 10 comprises a supporting portion 11 which is thick and forms a wall body, a variable portion 12 having a horizontal portion 12*a* and a sloping portion 12*b* and being extended at a small thickness in the shape of being contracted in a stepwise manner upwardly from the peripheral surface of the upper side of the supporting portion, 11, a ceiling portion 13 closing the upper side of the variable portion 12 with a large thickness, an outer flange 15 formed widely outwardly along the peripheral surface of the lower end portion of the supporting portion 11, and a pair of hinge portions 17, each being extended from one side of the outer flange 15. Here, as illustrated in FIG. 3, the supporting portion 11 is sloped such that its diameter becomes smaller as it goes further upwardly. And the internal volume of the ceiling portion 13 is changed as the height thereof changes up and down according to the variations of the variable portion 12 caused by an external force. At the center of the upper surface thereof is formed a maxi-flush loop 14. Inside the outer flange 15, as illustrated in FIG. 3, is formed a coupling recess 18 along the peripheral surface. At one side of the upper surface of the ceiling portion 13, is formed a mini-flush loop 16. At the end of each hinge portions 17, is formed a plurality of coupling holes 17*a* through which the hinge portion 17 is hinged to an overflow tube 31.

Next, the air housing 20 is formed in a cup shape that is protruded downwardly as shown in FIGS. 1 and 2. A coupling flange 21 is extended widely outwardly along the peripheral surface of the upper end portion of the air housing 20 which is completely open so that it can be coupled to the coupling recess 18 of the air chamber 10. Through the center of the bottom of the air housing 20 is penetrated a suction hole 22 in a circular shape and through one side of the upper portion thereof is penetrated an air vent 23.

In the thusly constructed water saving siphon cover 100, as the coupling flange 21 is coupled to the coupling recess 18, the air housing 20 forms an air room 30 inside along with the air chamber 10. Since the height of the ceiling portion 13 is changed due to a variation of the variable portion 12 caused by an external force, the volume of air held in the air room 30 is changed, which is resulted in a difference in buoyant force for lifting the water saving siphon cover 100 upwardly. Thus the water siphon cover 100 is operated in the principle of controlling the amount of wash water used for flushing urine and feces.

Therefore, the water siphon cover 100 of the present invention specifically proposes an optimum size required for changing the volume of the air room 30 for thereby completely preventing malfunctions. For this, the air housing 20 is formed with a thickness of 2 mm, being extended by 7.50 mm vertically from the periphery of a hemisphere with a radius of 20.03 mm. Then, the coupling flange 21 with a thickness of 1.2 mm is formed in the shape of being extended from the end of the air housing 20. The suction hole 22 is formed in the shape of a circle with a diameter of 60 mm. The air vent 23 is preferably formed adhesively to the lower side of the coupling flange 15 in the shape that provides a hemisphere having 2 mm diameter that is cut farther from below a rectangle with 4 mm width and 4.32 mm height. And the supporting portion 11 of the air chamber 10 is formed with 11.0 mm thickness having 57.692 mm outer diameter of the lower side and 53.163 mm outer diameter of the upper side. The variable portion 12 is formed with a thickness of 0.7 mm and the sloping portion 12*b* is curved upwardly from the boundary at an outer diameter of 44.169 mm of the horizontal portion 12*a*. The ceiling portion 13 is bordered on the sloping portion 12*b* at an outer diameter of 34.389 mm, in which the inner, lower surface is flat and the outer, upper surface is formed convexly with a shape of a curved surface having a radius of 48.562 mm. The coupling recess 18 is preferably formed at a position spaced 3 to 5 mm downwardly from the lower portion of the supporting portion 11. In such a construction, since the supporting portion 11 remains it its shape and the variable portion 12 is freely deformed according to an external force, the height of the ceiling portion 13 becomes changed, thus preventing a malfunction.

The thusly constructed water saving siphon cover 100 of the present invention, as shown in FIGS. 4 and 5, is installed such that the end of the hinge portion 17 blocks an outlet port 36 in a water tank 37, being hinged to the overflow tube 31. And it is operated in the following principle, thereby saving wash water.

Firstly, the operation for flushing urine will be described. At usual times, the water saving siphon cover 100 keeps in the installed position the state that the variable portion 12 and the ceiling portion 13 are pressed downwardly by a hydraulic force of wash water. Thus, as shown in FIGS. 5 and 6, the volume of the air room 30 formed by the air chamber 10 and the air housing 20 is minimized and the buoyant force is also minimized. In this state, when the mini-flush lever 33 is operated to lift a mini-flush chain 35, the mini-flush loop 16 portion formed at the upper side of the outer flange 15 is lifted, thus avoiding the deformation of the variable portion 12. Resultantly, the water saving siphon cover 100 is lifted upwardly with the hinge portion 17 at the center by a minimized buoyant force without a change in volume of the air room 30 containing air. Thusly, when the water saving siphon cover 100 is lifted upwardly, it continues to keep lifted by the buoyant force. As wash water is discharged through the outlet port 36 with a passage of time, the water level of the wash water becomes smaller and smaller and resultantly the air vent 23 of the air housing 20 is exposed above the water surface. From this time, air in the air room 30 is discharged to the outside and at the same time water is introduced via the suction hole 22, thereby rapidly reducing the buoyant force lifting the water saving siphon cover 100. Thusly, the water saving siphon cover 100 falls down within a short time by a gravity to thus block the outlet port 36.

On the other hand, in the operation for flushing feces, a maxi-flush chain 34 lifted by the operation of a maxi-flush lever 32 lifts the ceiling portion 13 formed with the maxi-flush loop upwardly. Thus, as the variable portion 12 is restored to the upper direction, the volume of the air room 30 is maximized and the buoyant force is also maximized. In this state, after the water saving siphon cover is lifted 100, if the water level of wash water is decreased, the water is introduced through the suction hole 22 as air is discharged via the air vent 23. At this point, however, the volume of the air room 30 is large unlike when flushing urine, the buoyant force for lifting the water saving siphon cover 100 is kept for a long time even if air was discharged via the air vent. Thus a longer period of time for opening the outlet port 36 is acquired as compared to the case of flushing urine for thereby discharging a large amount of wash water via the air vent 36.

Hence, as described above, the water saving siphon cover 100 can save water according to the required amount of wash water based on a change in the opening time of the outlet port 36 caused by a difference between the buoyant force for flushing urine and the buoyant force for flushing feces.

Meanwhile the water saving siphon cover 100 suggests a method of easily regulating the amount of wash water by a small quantity as a user pleases when it is desired to flush urine and feces. For this, as illustrated in FIG. 8, in the water saving siphon cover 100, a plurality of flow adjust scales 38 are arranged and sequentially carved with the same intervals at an angle of 90 to 180 degrees from the overflow tube 31 on either one of the upper and lower surfaces of the coupling flange 21 of the air chamber 10. As illustrated in FIG. 9, with reference to the flow adjust scales 38, the use amount of wash water can be changed by a small quantity by changing the position of the air vent 23 by rotating the air housing 20 transversely. In other words, if the air vent 23 is located at 0 degree, the height of the air vent 23 becomes larger for thereby making it faster to discharge air and reduce the buoyant force according to a decrease of a water level. Therefore, since the opening time of the outlet port 36 is short, a large amount of wash water can be saved. If the air vent 23 is located at 90 degrees, the height of the air vent 23 becomes smaller for thereby making it slower to discharge air and reduce the buoyant force according to a decrease of a water level. Therefore, since the opening time of the outlet port 36 is long, a large amount of wash water is discharged. Of course, if the air vent 23 is located at the rear portion of the angle of 90 degrees, a larger amount of wash water can be discharged. In this case, however, this is useless because it has no effect of detecting urine and saving water.

The thusly constructed and operated water saving siphon cover 100 prevents malfunctions by defining a precise shape and size for acquiring a buoyant force required for flushing urine and feces, thus saving a large amount of water. In the conventional construction, since a S-shaped corrugation is formed in many folds, it is not shrunken well by a water pressure. However, in the present invention, the variable portion 12 is well pressed by the water pressure and well restored to the original shape by an operation because it is very thin, thereby avoiding malfunctions. Moreover, as illustrated in FIG. 6, when pressing the variable portion 12 and the ceiling portion 13 by the water pressure, they are not closely adhered to each other inside the air chamber 10 because of the structural shape of the variable portion 12 comprising the horizontal portion 12*a* and the sloping portion 12*b*.

As described above, in the water saving siphon cover of the present invention, since the variable portion becomes very simplified, it has no possibility of malfunctions such as the adhesion to the inside of the air chamber, thus assuring its performance. As compared to the conventional art, it has a very simple structure and can be easily molded, which allows mass production at a low cost.

Further, with reference to the flow adjust scales, the use amount of wash water can be changed by a small quantity by changing the position of the air vent by rotating the air housing transversely.

What is claimed is:

1. A water saving siphon cover, comprising:

a flexible air chamber provided with a supporting portion which is thick and forms a wall body in the sloping shape that provides a smaller diameter as it goes upwardly, a variable portion having a horizontal portion and a sloping portion and being extended at a small thickness in the shape of being contracted in a stepwise manner upwardly from the peripheral surface of the upper side of the supporting portion, a ceiling portion with a maxi-flush loop at the center of the upper surface which blocks the upper side of the variable portion with a large thickness such that it can change the internal volume as the height is changed up and down according to a change of the variable portion caused by an external force, an outer flange which is formed widely outwardly along the peripheral surface of the lower end portion of the supporting portion and has a coupling recess formed convexly along the inner periphery and a mini-flush loop formed at one side of the upper surface, and a pair of hinge portions, each being extended from one side of the outer flange and each end being hinged to the protrusion of the overflow tube; and a rigid air housing formed in a cup shape that is protruded downwardly such that the inside can form an air room along with the inside of the air chamber, said air housing having a coupling flange extended widely outwardly along the peripheral surface of the upper end portion completely open so that it can be coupled to the coupling recess of the air chamber, a suction hole penetrated through the center of the bottom and an air vent penetrated through one side of the upper portion thereof.

2. The water saving siphon cover of claim 1, wherein the air housing is formed with a thickness of 2 mm, being extended by 7.50 mm vertically from the periphery of a hemisphere with a radius of 20.03 mm, the coupling flange with a thickness of 1.2 mm is formed in the shape of being extended from the end of the air housing, the suction hole is formed in the shape of a circle with a diameter of 60 mm, and the air vent is preferably formed adhesively to the lower side of the coupling flange in the shape that provides a hemisphere having 2 mm diameter that is cut farther from below a rectangle with 4 mm width and 4.32 mm height.

3. The water saving siphon cover of claim 1, wherein the supporting portion is formed with 1.0 mm thickness having 57.692 mm outer diameter of the lower side and 53.163 mm outer diameter of the upper side, the variable portion is formed with a thickness of 0.7 mm and the sloping portion is curved upwardly from the boundary at an outer diameter of 44.169 mm of the horizontal portion, the ceiling portion is bordered on the sloping portion 12*b* at an outer diameter of 34.389 mm, in which the inner, lower surface is flat and the outer, upper surface is formed convexly with a shape of a curved surface having a radius of 48.562 mm., and the coupling recess is preferably formed at a position spaced 3 to 45 mm downwardly from the lower portion of the supporting portion.

4. The water saving siphon cover of claim 1, wherein a plurality of flow adjust scales are arranged and sequentially carved with the same intervals at an angle of 90 to 180 degrees from the overflow tube on either one of the upper and lower surfaces of the coupling flange of the air chamber.

* * * * *